US005338234A

United States Patent [19]

Nanami

[11] Patent Number: 5,338,234

[45] Date of Patent: Aug. 16, 1994

[54] WATER INJECTION PROPULSION DEVICE

[75] Inventor: Masayoshi Nanami, Hamamatsu, Japan

[73] Assignee: Sanshin Kogyo Kabushiki Kaisha, Hamamatsu, Japan

[21] Appl. No.: 69,973

[22] Filed: May 28, 1993

[30] Foreign Application Priority Data

Jun. 17, 1992 [JP] Japan ..... 4-181517

[51] Int. Cl.[5] ..... B63H 16/08

[52] U.S. Cl. ..... 440/38; 239/265.11

[58] Field of Search ..... 440/38, 40, 41, 42, 440/47; 60/221, 222; 239/265.11, 265.19

[56] References Cited

U.S. PATENT DOCUMENTS 3,279,704 10/1966 Englehart et al. ..... 440/47
4,176,616 12/1979 Robins ..... 440/47
5,244,425 9/1993 Tasaki et al. ..... 440/47

FOREIGN PATENT DOCUMENTS 56-75296 6/1981 Japan .
0262290 10/1989 Japan .
0124395 5/1990 Japan .

*Primary Examiner*—Jesus D. Sotelo
*Attorney, Agent, or Firm*—Knobbe, Martens, Olson & Bear

[57] ABSTRACT

Several embodiments of water jet propulsion units having variable thrust devices by controlling the effective cross sectional area of the discharge nozzle. The rate of acceleration is sensed and the nozzle opening is changed in response to the sensed rate of acceleration.

28 Claims, 5 Drawing Sheets

WATER INJECTION PROPULSION DEVICE

BACKGROUND OF THE INVENTION

This invention relates to a water injection propulsion device and more particularly to an improved jet propulsion unit and control therefore for a watercraft.

Jet propulsion units are becoming a very popular form for propelling watercraft because of their numerous advantages over the more conventional propeller type drive. In order to further improve the performance of a jet propulsion unit, it has been proposed to provide a variable throat section in the jet propulsion unit. Normally, the effective cross sectional area of the discharge nozzle is varied so as to vary the thrust generated by the jet propulsion unit. At times, automatic controls have been proposed for so varying the effective area during running of the unit. However, the types of controls previously proposed have been responsive to the instantaneous condition rather than to changes in the operating condition of jet propulsion unit. Thus, these devices do not always provide optimum efficiency.

For example, the acceleration thrust of the jet propulsion unit can be significantly improved by varying the throat area of the discharge nozzle. With previously proposed devices and even those having automatic control, the area of the nozzle is varied in response to a given condition and hence the device does not anticipate the operator's desire.

It is, therefore, a principal object to this invention to provide an improved jet propulsion unit and control therefore wherein transient conditions are sensed and the jet propulsion unit has its effective area controlled in response to the rate of change of the condition.

As a specific example of a transient condition where it is desirable to anticipate the operator's desires, the acceleration thrust of a jet propulsion unit varies in response to the cross sectional area. If accelerating at a low rate of speed, it is desirable to gradually change the effective area of the jet propulsion unit. However, if rapid acceleration is being encountered, it is desirable to move the jet propulsion nozzle to its maximum effective area rapidly and then gradually reduce the opening to a somewhat more restricted area as the speed of the watercraft continues to increase.

It is, therefore, a still further object to this invention to provide an improved acceleration device for a jet propulsion unit and a method of operating the effective area of the jet propulsion unit in response to changes in rates of acceleration.

SUMMARY OF THE INVENTION

The invention is adapted to be embodied in a jet propulsion unit for a watercraft having a water inlet opening through which water is drawn, an impeller for drawing the water through the inlet opening and a discharge nozzle opening through which the water pumped by the impeller is discharged. One of the nozzle openings has a variable effective area.

In accordance with an apparatus constructed in accordance with an embodiment of the invention, means are provided for sensing a called for acceleration of the watercraft and varying the effective area of the opening in response to the rate of acceleration called for.

In accordance with a method for operating a jet propulsion unit as described in accordance with an embodiment of the invention, the rate of acceleration called for by the operator is sensed and the effective area of the opening is varied in response to the sensed called for rate of acceleration.

DETAILED DESCRIPTION OF THE PREFERRED EMBODIMENTS OF THE INVENTION

Figure 1:
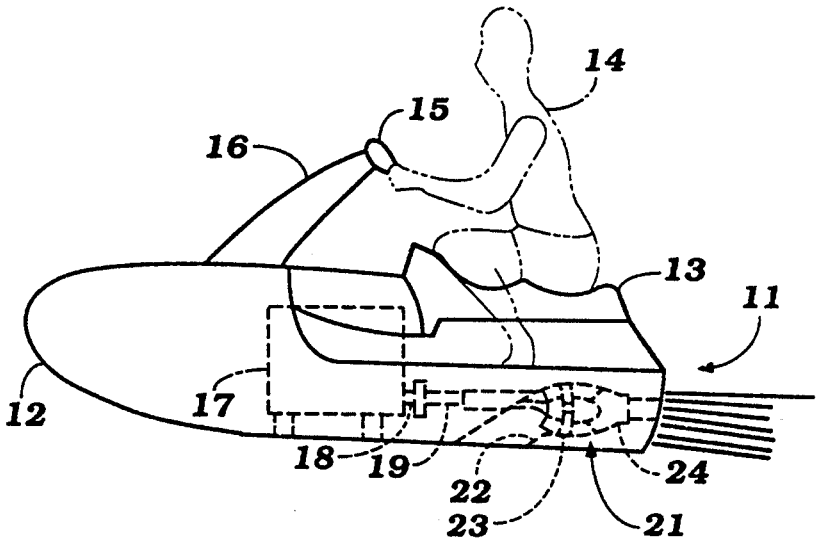
FIG. 1 is a side elevational view of a small watercraft showing the environment in which the invention can be employed and a first embodiment of the invention.

Referring now in details to the drawings and initially to FIG. 1, a small watercraft constructed in accordance with a first embodiment of the invention as identified generally by the reference numeral 11. The small watercraft 11 includes a hull 12 of any known configuration and, in the illustrated embodiment, the watercraft 11 provides a rearwardly positioned seat 13 on which a single rider 14 sits in straddle fashion. A handle bar assembly 15 is provided on a mast 16 forwardly of the seat 13 for control of the watercraft 11. It is to be understood that the construction of the watercraft 11 as described is for exemplary purposes only in that the invention may be employed with a wide variety of different types of watercraft powered by jet propulsion units.

An engine compartment is provided beneath the mast 16 and an internal combustion engine, shown schematically at 17 and which may be of any known type, is mounted in the engine compartment and has an output shaft 18. The output shaft 18 is coupled to an impeller shaft 19 of a jet propulsion unit, indicated generally by the reference numeral 21, and which is disposed in a tunnel positioned at the lower portion of the hull 12 beneath the seat 13.

The jet propulsion unit 21 includes a downwardly facing water inlet opening 22 through which water is drawn by means of an impeller 23 that is coupled for rotation with the impeller shaft 19. This water is then discharged rearwardly through a discharge nozzle 24 for propelling the watercraft 11 in a well known manner.

In accordance with the invention, the discharge nozzle 24 is constructed so as to provide a variable throat area depending upon operating conditions so as to vary the thrust generated by the jet propulsion unit 21. One variable nozzle assembly is shown in FIGS. 2 and 3 and will now be described by particular reference to those figures.

The discharge nozzle 24 is formed by an outer housing piece 25 and has a converging nozzle section 26 that receives the water pumped by the impeller 23. A steering nozzle 27 is supported at the rear end of the housing 25 on a pair of vertically disposed pivot pins 28 for steering of the associated watercraft in a well known manner. This portion of the construction as thus far described may be considered to be conventional.

In accordance with the invention, there is a provided a nozzle outlet area adjusting device, indicated generally by the reference numeral 29 which, in this embodiment, comprises a pair of nozzle sections 31 and 32 that are supported for pivotal movement about a transverse pivot axis on a pivot shaft 33 that is affixed to the housing 25 adjacent the end of the convergent nozzle 26. A garter type spring 34 is received in a groove 35 of the nozzle sections 31 and 32 for normally biasing them to their minimum diameter position as shown in FIG. 3.

Figure 2:
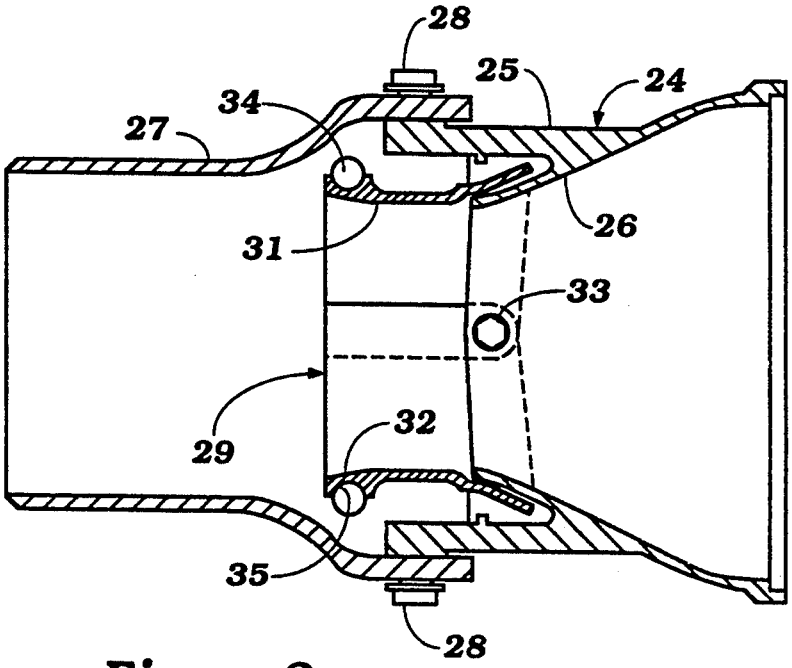
FIG. 2 is a cross sectional view taken through the discharge nozzle of the jet propulsion unit and shown in the maximum acceleration position.
Figure 3:
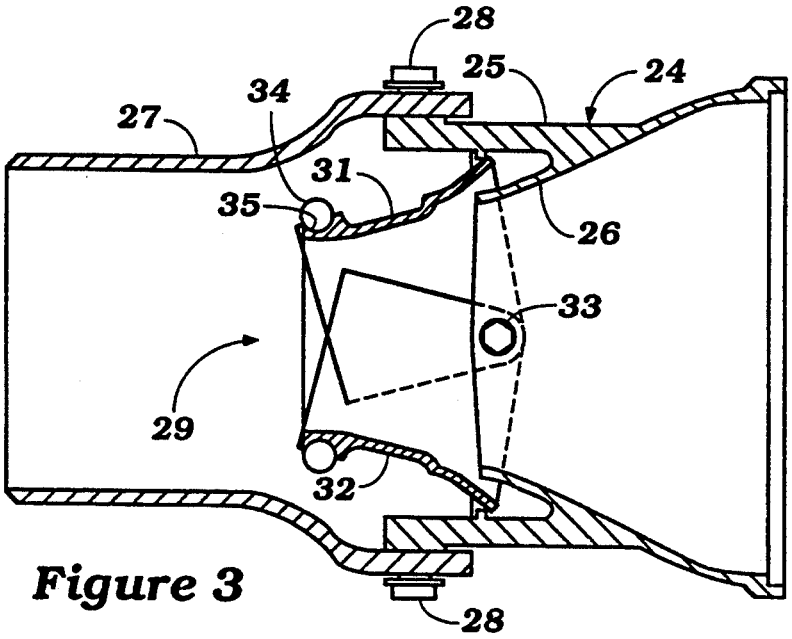
FIG. 3 is a cross sectional view, in part similar to FIG. 2, and shows the condition at low speed and when no significant acceleration is being experienced.

A suitable operating mechanism, examples of which will be given later, is provided for pivoting the nozzle sections 31 and 32 from the minimum diameter position to a maximum diameter position as shown in FIG. 2. This maximum diameter position $D_m$ is the normal maximum diameter for the nozzle area controlling mechanism 29. However, the nozzles sections 31 and 32 may be pivoted to a further open position slightly larger than that show in FIG. 2 to a high speed acceleration diameter ($D_s$), in a manner which will be described.

Figure 4:
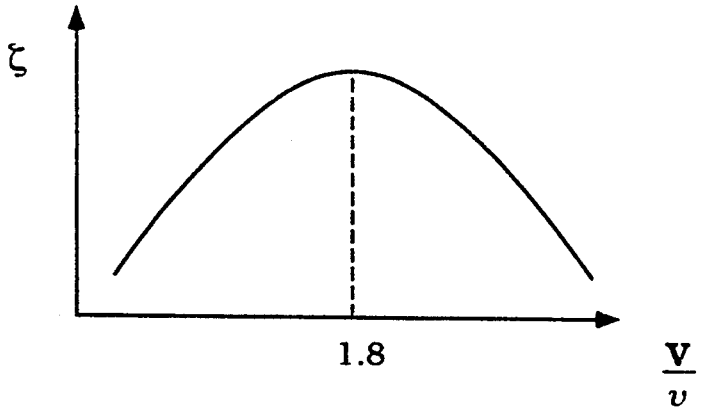
FIG. 4 is a graphical view showing the propulsion efficiency ($\eta$) in relation to the ratio of the velocity of the water existing the jet propulsion unit (V) to the speed of the vessel (v).

The effect of the nozzle diameter on the propulsion efficiency can be seen in FIG. 4 wherein there is a graphical view showing propulsion efficiency ($\eta$) in relation to the ratio of the speed of the water exiting the nozzle 24 (V) to the relation of the speed of the watercraft 11 (v). It may be seen that there is an optimum ratio at which the maximum efficiency occurs and this is when the velocity of the water exiting the nozzle 28 is approximately 1.8 times the velocity of the watercraft (v). Hence, it is a purpose of the invention to provide during acceleration conditions the appropriate relationship of water discharge speed to vessel speed and this is done by controlling the nozzle area by the nozzle area controlling mechanism 29 in a manner to be described.

Figure 5:
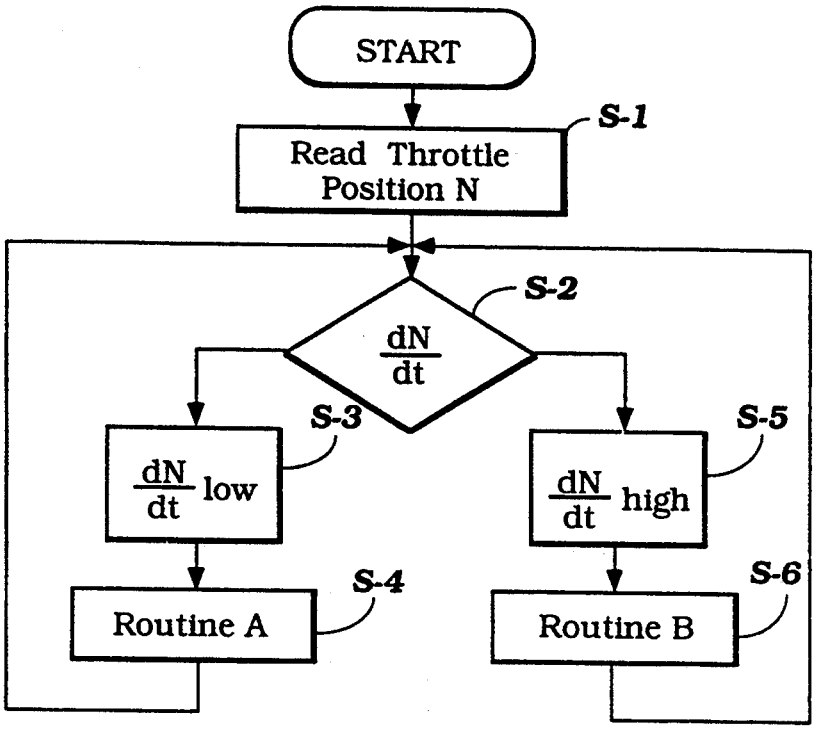
FIG. 5 is a block diagram showing the control routine in accordance with an embodiment of the invention.
Figure 6:
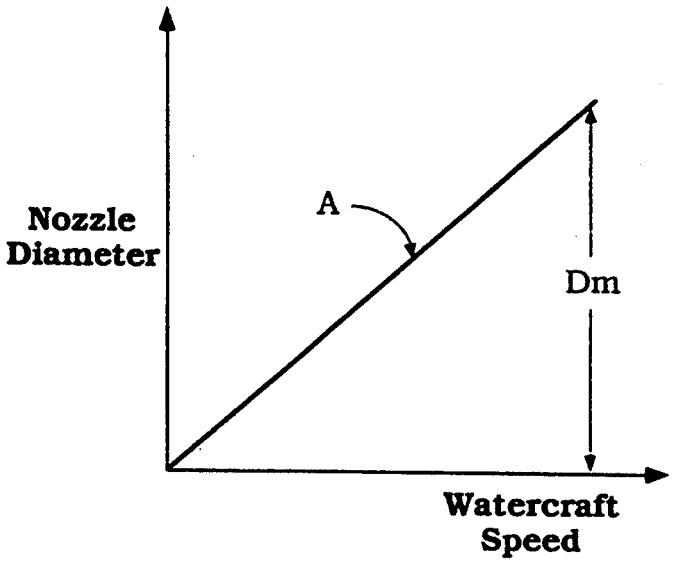
FIG. 6 is a diagrammatic view showing a first method of control routine as applied during gradual acceleration.
Figure 7:
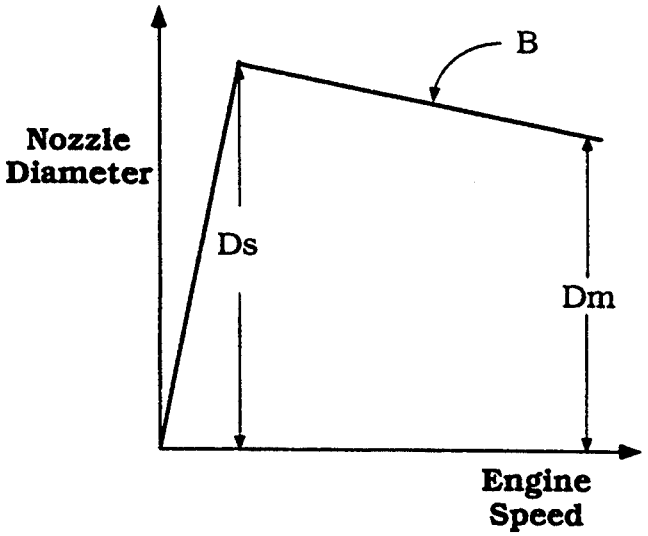
FIG. 7 is a graphical view showing a second method of control routine during rapid acceleration.

The control for the nozzle effective area controlling device 29 basically sets the effective cross sectional area at the optimum for a given speed of the engine and/or watercraft. However, a different problem is presented during transient conditions and the invention deals with the way in which the effective nozzle area is controlled in response to acceleration conditions. This method of operation will be described in particular reference to FIGS. 5 through 7, wherein FIG. 5 shows the control routine and FIGS. 6 and 7 show, respectively, the nozzle diameter control under slow or normal acceleration (FIG. 6) and under more rapid acceleration conditions. Basically, during slower acceleration, the nozzle effective area control device 29 is operated so as to gradually and slowly move it from its minimum diameter position to is maximum diameter position over a given time period which basically matches the change in watercraft speed. However, if rapid acceleration occurs, the nozzle 29 is first moved rapidly to its maximum diameter position $D_s$. and then is gradually reduced to its normal maximum diameter position $D_m$. This provides much better acceleration. These two control routines and relation of nozzle diameter to watercraft speed and engine speed, respectively, are shown in FIGS. 6 and 7. Obviously when the watercraft is accelerating rapidly, the engine speed will increase faster than the watercraft speed and this is why the nozzle diameter is increased more rapidly under this condition so as to provide the optimum efficiency in accordance with the graph shown in FIG. 4.

The method of operation will now be described by reference to FIG. 5. When the program starts, it moves to the step S-1 to read the throttle position of the operator controlled throttle for the engine 17. These individual throttle readings are taken and memorized in a CPU. The program then moves to the step S-2 so as to compare the throttle opening N at a predetermined time interval with the preceding throttle opening so as to determine the rate of opening of the throttle valve $$\frac{dN}{dt}.$$

If at the step S-2 it is determined that the throttle opening is gradual or slow, as noted by the box S-3, the program moves to the control routine A of FIG. 6 at the step S-4 and the diameter of the throttle controlling device 29 is gradually opened from the position shown in FIG. 3 to the position shown in FIG. 2.

If, however, it is determined at the step S-2 that the rate of throttle opening is high, the program moves to the step S-5 so as to initiate the rapid acceleration program and the program then moves to the step S-6 so as to first move the nozzle area control device 29 to its greater than normal maximum setting $D_s$and then gradually return the nozzle area control device 29 to its normal maximum position $D_m$ in accordance with the routine show in FIG. 7. As a result, the device provides very effective watercraft control. Because transient conditions are sensed and reacted to, the control is much faster than devices that are not responsive to transient conditions but only steady state conditions.

Figure 8:
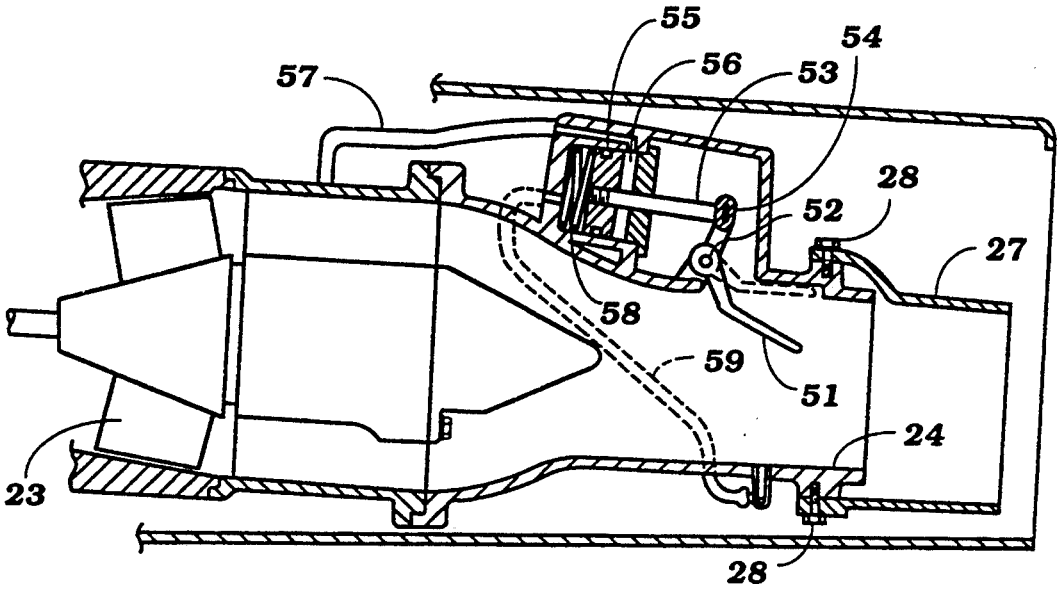
FIG. 8 is a cross sectional view through a portion of a jet propulsion unit constructed in accordance with another embodiment of the invention.

FIG. 8 shows another embodiment of the invention which differs from the embodiment of FIGS. 2 and 3 only in the way the effective nozzle area is controlled and, for that reason, components which are the same as the previously described embodiment have been identified by the same reference numerals and will be described again only insofar as is necessary to understand the construction and operation of this embodiment.

In this embodiment, a nozzle control member 51 is pivotally supported at one side of the discharge nozzle 24 on a pivot pin 52. The nozzle control device is pivotal between a minimum area position shown in FIG. 8, a greater than maximum position as shown in phantom lines in FIG. 8 and a normal maximum position that is slightly closed from the phantom line position.

A control rod 53 is pivotally connected to a lever 54 that is connected to the control member 51. A piston 55 is affixed to the control rod 53 in a bore that defines a first chamber 56 that is subject to a variable fluid pressure through a conduit 57 and control valve (not shown). The backside of the piston 55 is normally urged by means of a spring 58 and vent pressure conduit 59 to the position shown in FIG. 8. However, by pressurizing the line 57 the nozzle control member 51 may be moved to its less restricted position in accordance with the control routine shown in FIGS. 5 through 7 depending upon whether there is maximum or normal acceleration.

Figure 9:
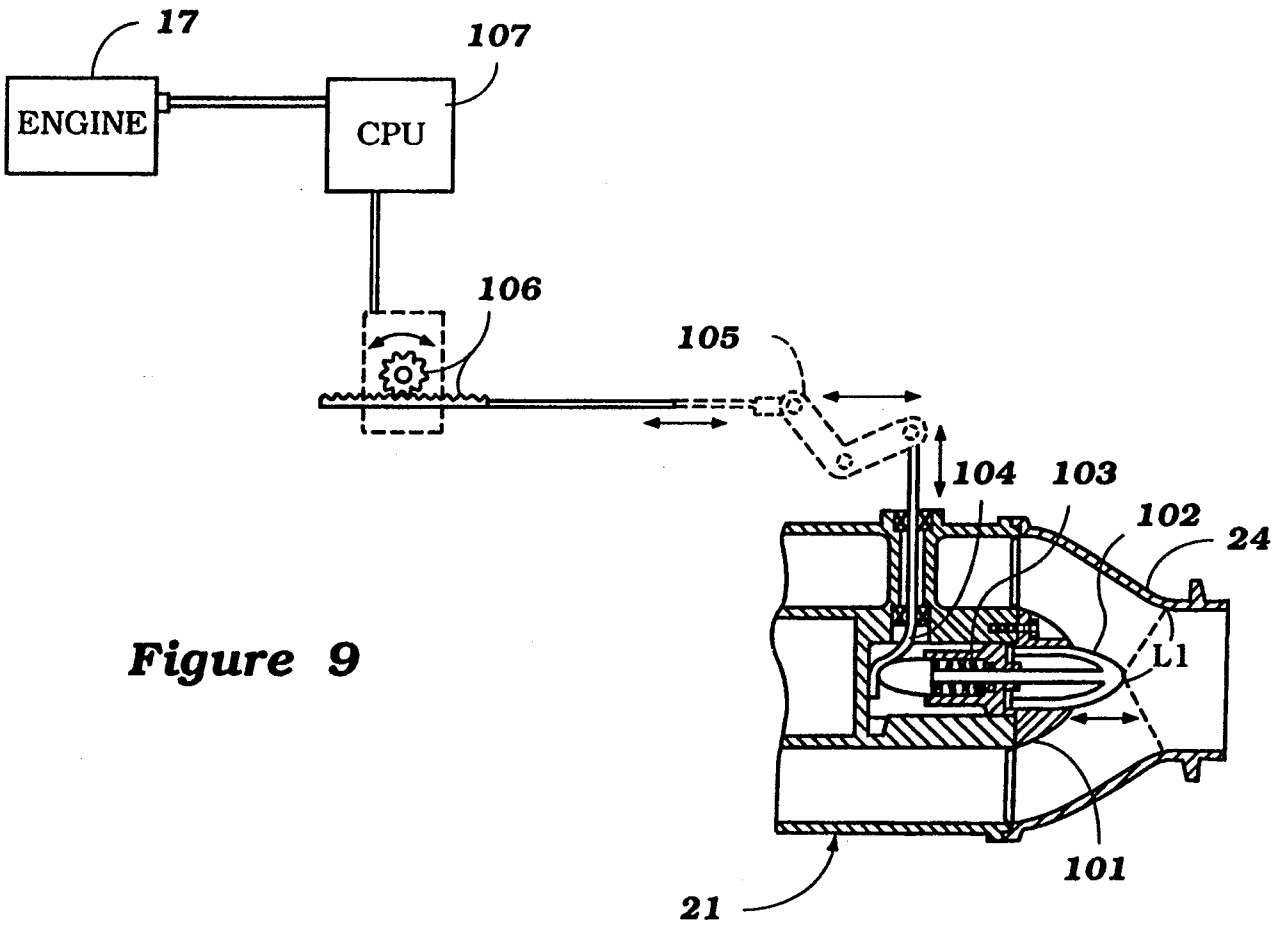
FIG. 9 is a partial cross sectional view taken through a jet propulsion unit constructed in accordance with another embodiment of the invention, with certain components shown schematically.

FIG. 9 shows another embodiment of the invention which differs from the previously described embodiments only in the manner in which the effective cross sectional area of the discharge nozzle 24 is controlled. For that reason, only this portion of the construction has been illustrated and will be described.

In this embodiment, the jet propulsion unit 21 has a nacelle 101 that slidably supports a nozzle area controlling member 102 and which is normally biased by means of a spring 103 to a maximum flow area position wherein the distance L1 between the end of the controlling member 102 and the inner portion of the nozzle 24 is at its maximum. However, a cam member 104 is slidably operated by means of a bellcrank 105 so as to urge the controlling member 102 against the action of the spring 103 to reduce the effective flow area. A rack and pinion gear train 106 is operated by a CPU 107 that receives signals from the engine 17 and specifically its throttle control so as to change the effective flow area in response to changes in throttle valve position and acceleration in accordance with the routine described in conjunction with FIGS. 5 through 7.

It should be readily apparent from the foregoing description that the described embodiments of the invention are extremely effective in providing good performance for a jet propulsion unit under variable transient conditions so as to provide optimum performance. In the embodiments as illustrated, the effective area of the discharge opening has been changed, as a preferred way of practicing the invention. However, as has been noted, the variable throat area section can be positioned elsewhere in the jet-propulsion unit. Of course, the foregoing description is that of a preferred embodiment of the invention and various changes and modifications may be made without departing from the spirit and scope of the invention, as defined by the appended claims.

I claim:

1. A jet propulsion unit for a watercraft comprised of a water inlet opening through which water may be drawn from a body of water, an impeller for pumping water through said water inlet opening, and a discharge nozzle opening for discharging water pumped by said impeller for generating a driving thrust, means for changing the effective area of one of said openings for varying the thrust of said jet propulsion unit, means for sensing the acceleration of said jet propulsion unit, and means for varying the effective area of said opening in response to the sensed rate of acceleration.

2. A jet propulsion unit for a watercraft as set forth in claim 1 wherein the opening having its effective area changed comprises the discharge nozzle opening.

3. A jet propulsion unit for a watercraft as set forth in claim 1 wherein the means for varying the effective area of the opening provides different ratios of speed of change in the effective area of the opening in response to difference speeds of acceleration.

4. A jet propulsion unit for a watercraft as set forth in claim 3 wherein the means for varying the effective area of the opening gradually increases the effective area when the jet propulsion unit is slowly accelerated.

5. A jet propulsion unit for a watercraft as set forth in claim 3 wherein the means for varying the effective area of the opening effects rapid increase of the effective area in response to a rapid acceleration.

6. A jet propulsion unit for a watercraft as set forth in claim 5 wherein the means for varying the effective area increases the effective area to a predetermined greater than maximum opening upon initial sensed rapid acceleration and then a gradual decrease to a normal maximum opening.

7. A jet propulsion unit for a watercraft as set forth in claim 6 wherein the means for varying the effective area of the opening gradually increases the effective area when the jet propulsion unit is slowly accelerated.

8. A jet, propulsion unit for a watercraft as set forth in claim 3 further including an engine for driving the jet propulsion unit and the means for sensing the acceleration of the jet propulsion unit senses the acceleration of the driving engine.

9. A jet propulsion unit for a watercraft as set forth in claim 8 wherein the associated engine has a throttle valve for changing its speed and wherein the means for sensing acceleration senses the rate of change in position of the throttle valve.

10. A jet propulsion unit for a watercraft as set forth in claim 9 wherein the means for varying the effective area of the opening provides different ratios of speed of change in the effective area of the opening in response to different speeds of acceleration.

11. A jet propulsion unit for a watercraft as set forth in claim 9 wherein the means for varying the effective area of the opening gradually increases the effective area when the jet propulsion unit is slowly accelerated.

12. A jet propulsion unit for a watercraft as set forth in claim 9 wherein the means for varying the effective area of the opening effects rapid increase of the effective area in response to a rapid acceleration,

13. A jet propulsion unit for a watercraft as set forth in claim 12 wherein the means for varying the effective area increases the effective area to a predetermined greater than maximum opening upon initial sensed rapid acceleration and then a gradual decrease to a normal maximum opening.

14. A jet propulsion unit for a watercraft as set forth in claim 13 wherein the means for varying the effective area of the opening gradually increases the effective area when the jet propulsion unit is slowly accelerated.

15. A method of operating a jet propulsion unit for a watercraft comprised of a water inlet opening through which water may be drawn from a body of water, an impeller for pumping water through said water inlet opening, and a discharge nozzle opening for discharging water pumped by said impeller for generating a driving thrust and means for changing the effective area of one of said openings for varying the thrust of said jet propulsion unit, said method comprising the steps of sensing the acceleration of said jet propulsion unit and varying the effective area of said opening in response to the sensed rate of acceleration.

16. A method of operating a jet propulsion unit for a watercraft as set forth in claim 15 wherein the opening having its effective area changed comprises the discharge nozzle opening.

17. A method of operating a jet propulsion unit for a watercraft as set forth in claim 15 wherein the effective area of the opening is varied to provide different ratios of speed of change in the effective area of the opening in response to difference speeds of acceleration.

18. A method of operating a jet propulsion unit for a watercraft as set forth in claim 17 wherein the effective area of the opening is gradually increased when the jet propulsion unit is slowly accelerated.

19. A method of operating a jet propulsion unit for a watercraft as set forth in claim 17 wherein the effective area of the opening is rapidly increased in response to a rapid acceleration.

20. A method of operating a jet propulsion unit for a watercraft as set forth in claim 19 wherein the effective area is increased to a predetermined greater than maximum opening upon initial sensed rapid acceleration and then gradually decreased to a normal maximum opening.

21. A method of operating a jet propulsion unit for a watercraft as set forth in claim 20 wherein the effective area of the opening is gradually increased when the jet propulsion unit is slowly accelerated.

22. A method of operating a jet propulsion unit for a watercraft as set forth in claim 17 further including an engine for driving the jet propulsion unit and the acceleration of the jet propulsion unit is sensed by sensing the acceleration of the driving engine.

23. A method of operating a jet propulsion unit for a watercraft as set forth in claim 22 wherein the associated engine has a throttle valve for changing its speed and the rate of change in position of the throttle valve is sensed to determine acceleration.

24. A method of operating a jet propulsion unit for a watercraft as set forth in claim 23 wherein the effective area of the opening is changed at different ratios of speed of change in response to different speeds of acceleration.

25. A method of operating a jet propulsion unit for a watercraft as set forth in claim 23 wherein the effective area of the opening is gradually increased when the jet propulsion unit is slowly accelerated.

26. A method of operating a jet propulsion unit for a watercraft as set forth in claim 23 wherein the effective area of the opening is rapidly increased in response to a rapid acceleration.

27. A method of operating a jet propulsion unit for a watercraft as set forth in claim 26 wherein the effective area is increased to a predetermined greater than maximum opening upon initial sensed rapid acceleration and then gradually decreased to a normal maximum opening.

28. A method of operating a jet propulsion unit for a watercraft as set forth in claim 27 wherein the effective area of the opening is gradually increased when the jet propulsion unit is slowly accelerated.

* * * * *